US007874448B1

(12) United States Patent
Doherty et al.

(10) Patent No.: US 7,874,448 B1
(45) Date of Patent: Jan. 25, 2011

(54) PAINT TRAY LINER APPARATUS

(76) Inventors: John Daniel Doherty, 80 Antibes Drive, Apartment #1104, Toronto, ON (CA) M2R 3N5; Claudio Marino, 80 Antibes Drive, Apartment #1104, Toronto, ON (CA) M2R 3N5

( * ) Notice: Subject to any disclaimer, the term of this patent is extended or adjusted under 35 U.S.C. 154(b) by 239 days.

(21) Appl. No.: 12/247,173

(22) Filed: Oct. 7, 2008

(51) Int. Cl.
*B65D 25/14* (2006.01)
*B05C 21/00* (2006.01)

(52) U.S. Cl. ..... 220/495.02; 220/570; 15/257.06

(58) Field of Classification Search ..... 220/495.02, 220/570; 15/257.06
See application file for complete search history.

(56) References Cited

U.S. PATENT DOCUMENTS 2,887,705 A 5/1959 Serwer
3,157,902 A * 11/1964 Hardwick ..... 15/257.06
3,514,012 A 5/1970 Martin
6,196,410 B1 3/2001 Hocking
D485,955 S 1/2004 Johnson
D569,567 S * 5/2008 Kohn ..... D32/53.1
D612,119 S * 3/2010 Bergman ..... D32/54
2006/0037960 A1 2/2006 Rosa
2007/0246484 A1 10/2007 Yoshida et al.

* cited by examiner

*Primary Examiner*—Harry A Grosso
(74) *Attorney, Agent, or Firm*—Crossley Patent Law; Mark A. Crossley

(57) ABSTRACT

The paint tray liner apparatus provides removable fit to an existing paint tray, thereby providing a disposable liner. Flexible sides are collapsible and the liner bottom relatively rigid. The collapsible sides provide for reduced space storage of the apparatus, whether prior to use or after when discarded. The collapsible sides each has an inner panel spaced apart from an outer panel. Each inner and outer panel is connected by the continuous shelf. The side panels thereby fit the sides of a paint tray, with the apparatus tray bottom against a paint tray bottom.

1 Claim, 4 Drawing Sheets

PAINT TRAY LINER APPARATUS

BACKGROUND OF THE INVENTION

Paint trays used with paint rollers have been in widespread use for many decades. Cleaning of paint trays is expensive both in time and in solvents typically used to clean them. Previously, tray liners have been provided, typically of plastic, so that the liner can be discarded and tray cleanup negated. The present liner apparatus provides the ideal alternative to paint tray cleanup.

FIELD OF THE INVENTION

The paint tray liner apparatus relates to paint trays and more especially to a disposable paint tray liner apparatus with collapsible sides for easy storage prior to use and easy disposal after use, along with a relatively rigid bottom which makes handling and use easier.

SUMMARY OF THE INVENTION

The general purpose of the paint tray liner apparatus, described subsequently in greater detail, is to provide a paint tray liner apparatus which has many novel features that result in an improved paint tray liner apparatus which is not anticipated, rendered obvious, suggested, or even implied by prior art, either alone or in combination thereof.

To attain this, the paint tray liner apparatus provides removable fit to an existing paint tray. Rather than having to clean a paint tray, the liner apparatus is used, then discarded, thereby saving time and cleaning solvents and preventing any color contaminations caused by less than perfectly clean trays. The tray liner apparatus provides highly flexible sides which can be collapsed toward the more rigid liner bottom. The rigidity of the liner bottom is at least 3 times that of the sides. The collapsible sides provide for reduced space storage of the apparatus, whether prior to use or after when discarded. The collapsible sides each has an inner panel spaced apart from an outer panel. Each inner and outer panel is connected by the continuous shelf. The side panels thereby fit the sides of a paint tray, with the apparatus tray bottom against a paint tray bottom. The apparatus thereby provides sufficient rigidity in use, with collapsibility when not in use. The apparatus is therefore optionally offered in multiples per sales container. Further, with sides thinner than the tray bottom, less expense is encountered in material cost in production of the apparatus, as opposed to a completely rigid tray liner.

The slant of the liner bottom features ribs with waves and centrally disposed rounded V's. Each rib end is spaced away from the inner side panels. Paint on the slant thereby flows toward the tray of the liner bottom, but not too rapidly. The ribs can also assist in squeezing desires quantities from a roller, as needed.

Thus has been broadly outlined the more important features of the improved paint tray liner apparatus so that the detailed description thereof that follows may be better understood and in order that the present contribution to the art may be better appreciated.

An object of the paint tray liner apparatus is to provide a disposable liner for a paint tray.

Another object of the paint tray liner apparatus is to provide a relatively rigid bottom.

A further object of the paint tray liner apparatus is to provide collapsible sides for easy storage and disposal.

An added object of the paint tray liner apparatus is to be inexpensively produced and sold.

And, an object of the paint tray liner apparatus is to provide proper paint flow and retention within the liner bottom.

These together with additional objects, features and advantages of the improved paint tray liner apparatus will be readily apparent to those of ordinary skill in the art upon reading the following detailed description of presently preferred, but nonetheless illustrative, embodiments of the improved paint tray liner apparatus when taken in conjunction with the accompanying drawings.

In this respect, before explaining the current embodiments of the improved paint tray liner apparatus in detail, it is to be understood that the paint tray liner apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved paint tray liner apparatus. It is therefore important that the claims be regarded as including such equivalent constructions insofar as they do not depart from the spirit and scope of the paint tray liner apparatus. It is also to be understood that the phraseology and terminology employed herein are for purposes of description and should not be regarded as limiting.

DETAILED DESCRIPTION OF THE DRAWINGS

Figure 1:
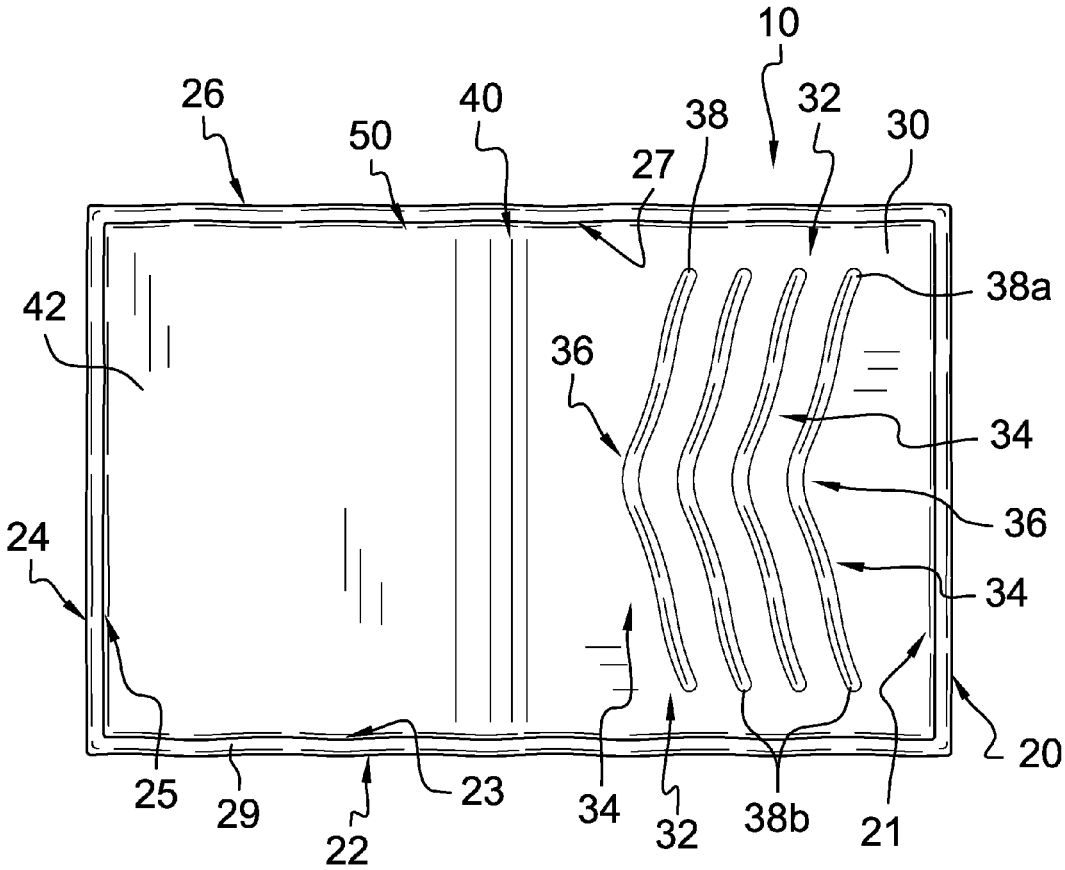
FIG. 1 is a top plan view.
Figure 2:
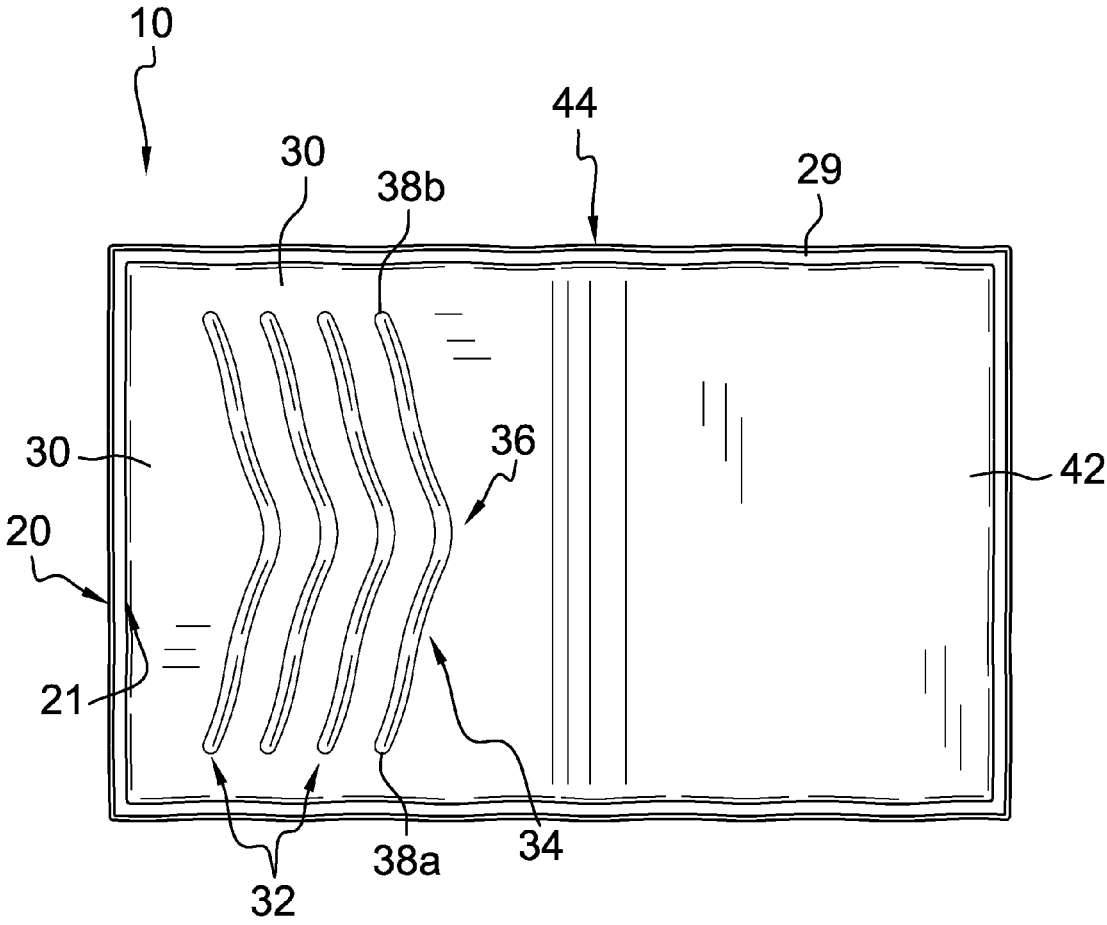
FIG. 2 is a top plan view.
Figure 3:
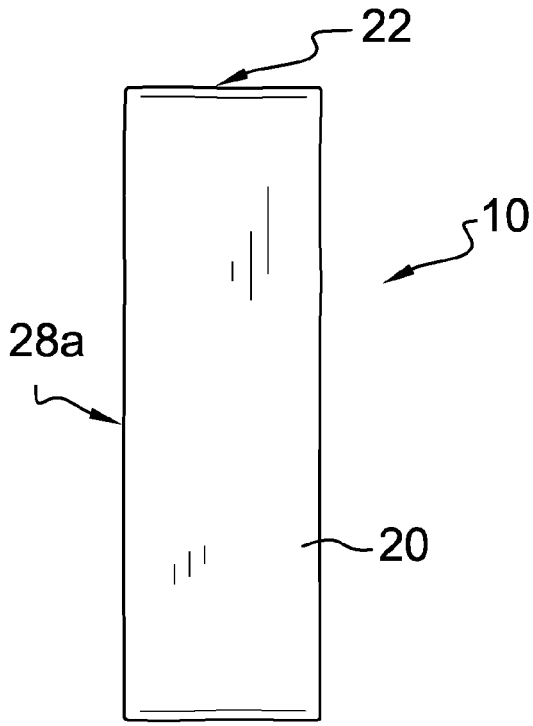
FIG. 3 is a first side elevation view, second side up.
Figure 4:
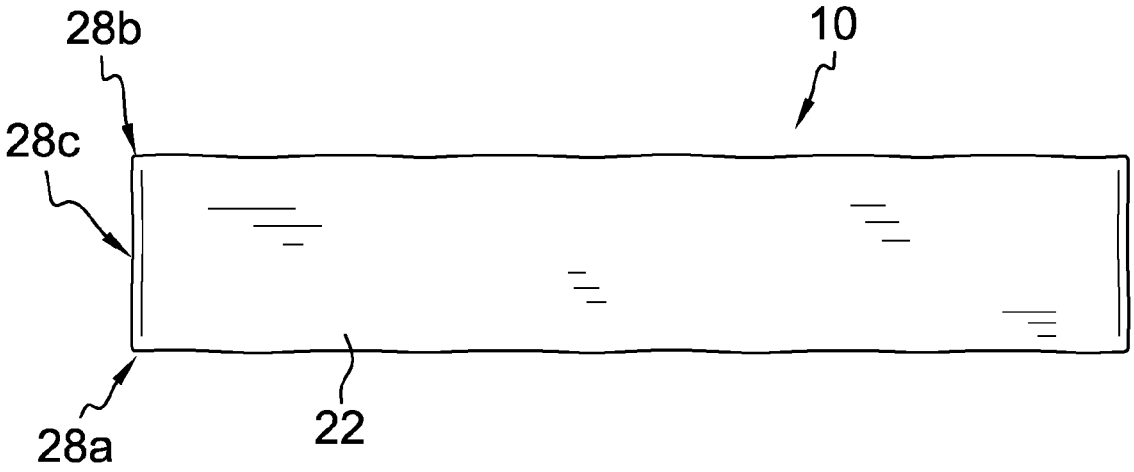
FIG. 4 is a second side elevation view.
Figure 5:
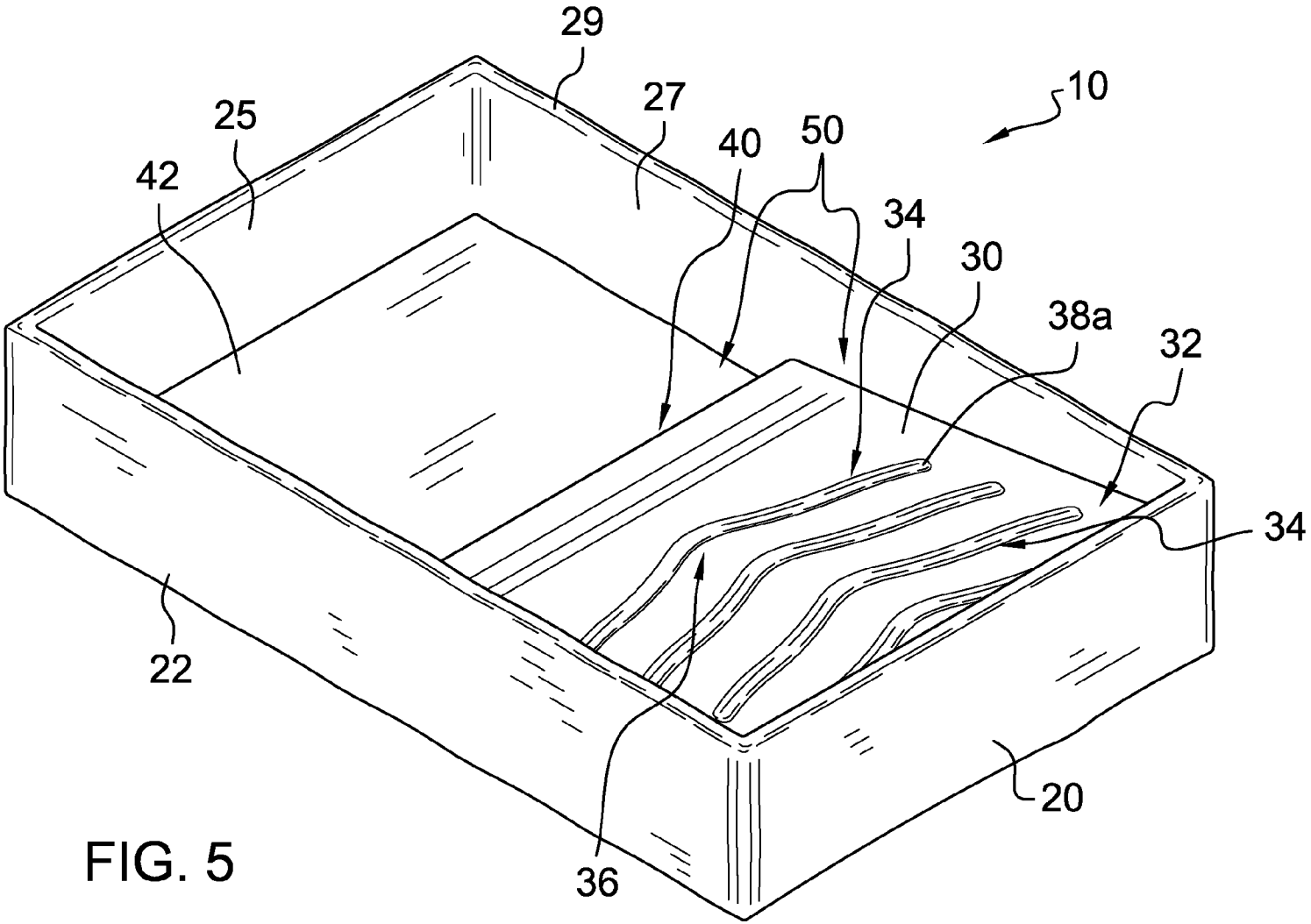
FIG. 5 is a perspective view.

With reference now to the drawings, and in particular FIGS. 1 through 5 thereof, the principles and concepts of the paint tray liner apparatus generally designated by the reference number 10 will be described.

Referring to FIGS. 1-5, the paint tray liner apparatus 10 is provided for removable fit to an existing paint tray. The apparatus 10 comprises a rectangular shape having inner and outer panels. Each panel has a top 28*b*, a bottom 28*a*, and a midpoint 28*c*. The inner and outer panels comprise the first side inner panel 21 spaced apart from the first side outer panel 20, the second side inner panel 23 spaced apart from the second side outer panel 22, the third side inner panel 25 spaced apart from the third side outer panel 24, and the fourth side inner panel 27 spaced apart from the fourth side outer panel 26. The shelf 29 is disposed between the top 28*b* of each inner and outer panel, respectively. The inner and outer panels and the shelf 29 are comprised of thin, low rigidity plastic and are collapsible. The inner and outer panels and shelf 29 provide for the collapsible panels to fit a paint tray sides and therefore remain upright when in position. The liner bottom 50 is disposed between and connected to the inner panels. The liner bottom 50 has a rigidity at least three times that of the side panels and shelf 29. The liner bottom 50 partially comprises the slant 30 which is extended from proximal to the midpoint 28*c* of the first side inner panel 21. The slant 30 is sloped downwardly toward the approximate center 44 of the liner bottom 50.

The slant 30 center 44 is spaced above the bottom 28*a* of the side panels. The slant 30 further comprises the plurality of elevated spaced apart ribs 32. Each rib 32 has spaced apart rounded ends comprised of a first end 38*a* and a second end 38*b*. Each first end 38*a* is spaced apart from the fourth side inner panel 27. Each second end 38*b* is spaced apart from the second side inner panel 23. A rounded V 36 is disposed in the center of each rib 32. Each rounded V 36 is more proximal to the center 44 of the liner bottom 50 than the rib ends. A wave 34 is disposed between end rib end and the rounded V 36. The flat tray 42 is extended from the bottom 28*a* of the third side inner panel 25. The tray 42 extends to the center 44 of the liner bottom 50. The step 40 connects the slant 30 to the tray 42.

With respect to the above description then, it is to be realized that the optimum dimensional relationships for the parts of the paint tray liner apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the paint tray liner apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the paint tray liner apparatus may be used.

Therefore, the foregoing is considered as illustrative only of the principles of the paint tray liner apparatus. Further, since numerous modifications and changes will readily occur to those skilled in the art, it is not desired to limit the paint tray liner apparatus to the exact construction and operation shown and described, and accordingly, all suitable modifications and equivalents may be resorted to, falling within the scope of the paint tray liner apparatus.

What is claimed is:

1. A paint tray liner apparatus removably fitted to an existing paint tray, the apparatus comprising:

a rectangular shape having inner and outer panels and a center, each panel having a top and a bottom and a midpoint, the inner and outer panels comprising:

a first side inner panel spaced apart from a first side outer panel;

a second side inner panel spaced apart from a second side outer panel;

a third side inner panel spaced apart from a third side outer panel;

a fourth side inner panel spaced apart from a fourth side outer panel;

a shelf between the top of each inner and outer panel, respectively, the inner and outer panels and shelf collapsible;

a liner bottom disposed between and connected to the inner panels, the liner bottom having a rigidity at least three times that of the side panels and shelf, the liner bottom comprising:

a slant extended from proximal to the midpoint of the first inner panel, the slant sloped downwardly toward an approximate center of the liner bottom, the slant further comprising:

a plurality of elevated spaced apart ribs, each rib having spaced apart rounded ends comprised of a first end and a second end, each first end spaced apart from the fourth side inner panel, each second end spaced apart from the second side inner panel;

a rounded V disposed in a center of each rib, each rounded V more proximal to the center of the liner bottom than the rib ends;

a wave between each rib end and the rounded V;

a flat tray extended from the bottom of the third side inner panel, the tray extended to the center of the liner bottom;

a step connecting the slant to the tray.

* * * * *